US007315284B2

(12) United States Patent
Hsu et al.

(10) Patent No.: US 7,315,284 B2
(45) Date of Patent: Jan. 1, 2008

(54) PORTABLE DEVICE AND ANTENNA THEREOF

(75) Inventors: Chieh-Sheng Hsu, Taipei Hsien (TW); Chang-Hsiu Huang, Taipei Hsien (TW)

(73) Assignee: Wistron NeWeb Corporation, Hsi-Chih City, Taipei Hsien (TW)

( * ) Notice: Subject to any disclaimer, the term of this patent is extended or adjusted under 35 U.S.C. 154(b) by 0 days.

(21) Appl. No.: 11/534,209

(22) Filed: Sep. 21, 2006

(65) Prior Publication Data

US 2007/0241967 A1 Oct. 18, 2007

(30) Foreign Application Priority Data

Apr. 17, 2006 (TW) ..... 95113671 A

(51) Int. Cl.
*H01Q 1/38* (2006.01)

(52) U.S. Cl. ..... 343/700 MS; 343/702; 343/846

(58) Field of Classification Search ..... 343/700 MS, 343/702, 846
See application file for complete search history.

(56) References Cited

U.S. PATENT DOCUMENTS 6,359,589 B1 * 3/2002 Bae ..... 343/700 MS
6,825,811 B2 * 11/2004 Iwai et al. ..... 343/702
2006/0267843 A1 * 11/2006 Sakama et al. ..... 343/700 MS

* cited by examiner

*Primary Examiner*—Hoang V. Nguyen
(74) *Attorney, Agent, or Firm*—Winston Hsu

(57) ABSTRACT

An antenna comprises a substrate, a grounding element and a radiating element. The grounding element has an opening and is disposed on a first surface of the substrate. The radiating element is disposed on a second surface and electrically connects to the grounding element. A projection on the first surface of the radiating element partially covers the opening.

29 Claims, 18 Drawing Sheets

PORTABLE DEVICE AND ANTENNA THEREOF

BACKGROUND OF THE INVENTION

1. Field of the Invention

The invention relates to an antenna and in particular to a broadband antenna.

2. Description of the Prior Art

As the wireless telecommunication develops with the trend of micro-sized mobile communication product, the location and the space arranged for antennas are limited. Therefore, some built-in micro antennas have been used. Currently, some micro antennas such as a chip antenna, a planar antenna, and so on are commonly used. All these antennas have the feature of small volume. For example, a common chip antenna applying LTCC technology is known as a ceramic chip antenna. Additionally, planar antennas are also designed in many types such as a microstrip antenna, a printed antenna, and a Planar Inverted F Antenna. These antennas are applied widely to GSM, DCS, UMTS, WLAN, Bluetooth, etc. Despite the above antennas meeting the need of micro size, bandwidth will be insufficient. Under the circumstance, when the human body approaches the antenna, the antenna will be interfered with by inducing a frequency bias. Then, performance of the antenna will get worse and eventually malfunction.

To receive all kinds of frequencies, many antennas with different frequency are connected to a portable device. However, as the portable device is getting smaller along with the fact that other components limit the space of the antenna, the difficulty of antenna design inevitably increases. Besides, when the antenna is arranged, the shutter effect of human body may cause frequency bias of the antenna, further weakening the radiation effects of the antenna.

Therefore, an antenna structure design meeting the needs of increasing bandwidth, decreasing the shutter effect of human body, and not affecting the radiation effect is an important issue.

SUMMARY OF THE INVENTION

Portable device and antenna thereof are provided. The invention provides an antenna that includes a substrate, a grounding element, and a radiating element. The grounding element has an opening and is disposed on a first surface of the substrate. The radiating element is disposed on a second surface and electrically connects to the grounding element. A projection on the first surface of the radiating element partially covers the opening.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
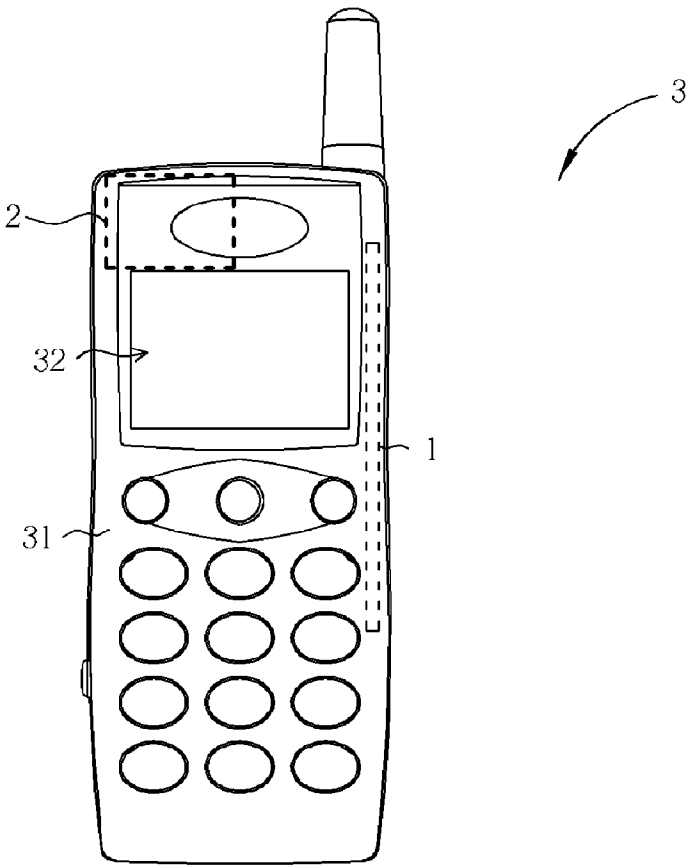
FIG. 1 is a perspective view of an antenna of an embodiment of the invention disposed in an electronics device.

Portable device and antenna thereof according to the present invention will be described in greater detail in the following. Please refer to FIG. 1. An antenna 1 is disposed in a housing 31 of a portable device (mobile phone) 3. The housing 31 comprises a display unit 32 and the antenna is disposed on one side of the display unit 32. Additionally, another antenna 2 is disposed above the display unit 2 and in the housing 31. In this embodiment, the antenna 1 is WiFi antenna and the antenna 2 is used to receive satellite signals.

Figure 2:
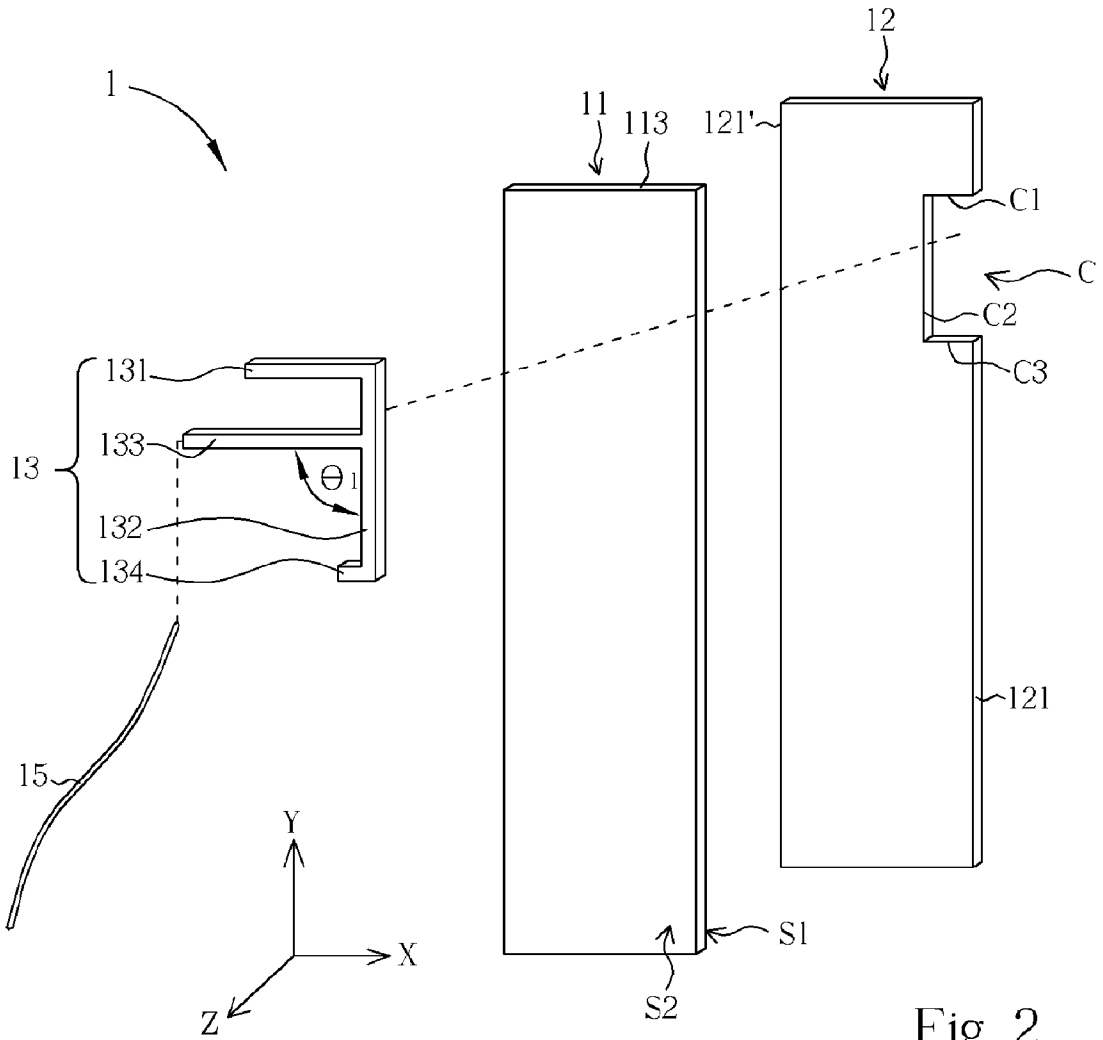
FIG. 2 is an exploded view of an antenna of an embodiment of the invention.

Please next refer to FIG. 2 showing the antenna 1. The antenna 1 comprises a substrate 11, a grounding element 12, a radiating element 13, and a cable 15. The grounding element 12 is disposed on a first surface S1 of the substrate 11 and comprises a substantially rectangular opening C. The opening is defined on one edge 121 of the grounding element 12 and the opening C comprises a first edge C1, a second edge C2, and third edge C3. The second edge C2 is connected to and perpendicular to the first edge C1 and the third edge C3. The radiating element 13 is disposed on a second surface S2 of the substrate 11 and electrically connected to the grounding element 12. The cable 15 is connected to the radiating element 13 from the second surface S2 to transmit signals. When projected to the first surface S1, the radiating element 13 substantially corresponds to the opening C and partially overlaps the opening C.

The radiating element 13 comprises a ground portion 131, an interconnection portion 132, a feeding portion 133, and an extension portion 134. The ground portion 131 is connected to the grounding element 12. Additionally, the feeding portion 133 is connected to the cable 15 and the interconnection portion 132 is applied to connect the ground portion 131, the feeding portion 133, and the extension portion 134. An angle θ1 between the interconnection portion 132 and the feeding portion 133 is from 0 degrees to 180 degrees.

Figure 3:
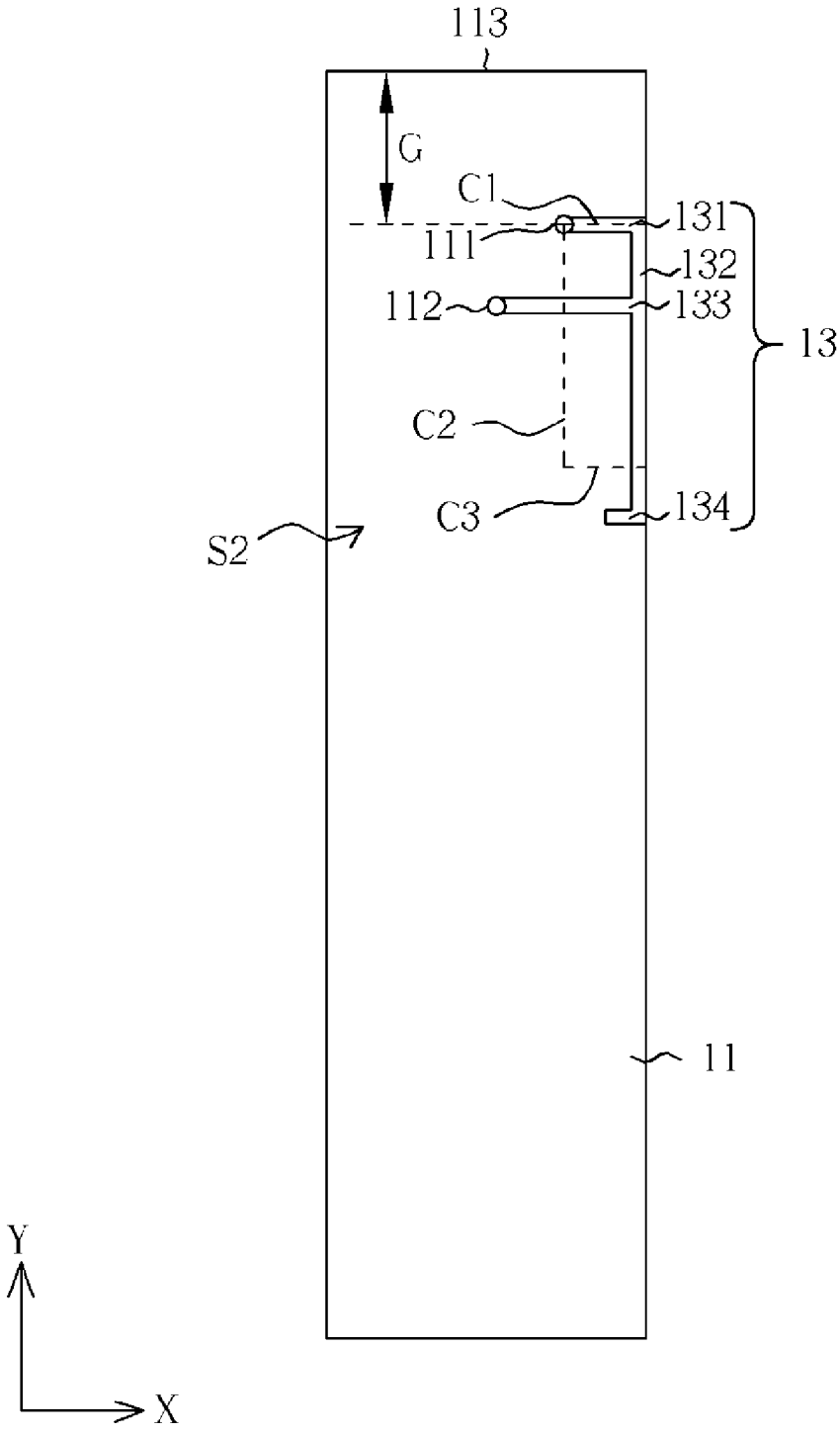
FIG. 3 is a schematic view of an antenna of an embodiment of the invention.

Please refer to FIG. 2 and FIG. 3. As shown, the ground portion 131 substantially corresponds to the first edge C1 of the opening C, the interconnection portion 132 substantially corresponds to the opening of the opening C, the feeding portion 133 crosses the second edge C2 of the opening C, and the extension portion 134 substantially corresponds to the third edge C3 of the opening C. Specifically, the ground portion 131 is parallel to the first edge C1 of the opening C and the projection of the ground portion 131 on the first surface S1 is located on the first edge C1 of the opening C. Furthermore, the interconnection portion 132 is parallel and adjacent to an edge 121 of the grounding element 12. The extension portion 134 is parallel to the third edge C3 of the opening C and the projection of the extension portion 134 on the first surface S1 is adjacent to the third edge C3 of the opening C. The ground portion 131, the interconnection portion 132, the feeding portion 133, and the extension portion 134 of the radiating element 13 are respectively corresponding to the opening C, and the arrangement thereof is substantially E-shaped.

In this embodiment, a distance G formed between the first edge C1 of the opening C and an edge 113 is at least 1 mm. Moreover, the second edge C2 of the opening C is parallel to an edge 121' of the grounding element 12. The length of the ground portion 131 is five times longer than the length of the second edge C2 of the opening C. Further, the length of the ground portion 131 is substantially the same as the width of the opening C. That is, the position where the ground portion 131 is electrically connected to the grounding element 12 is exactly located in a corner of the opening C. In this case, the angle θ1 between the interconnection portion 132 and the feeding portion 133 is 90 degrees.

Additionally, due to the arrangement of the cables, it is optional to drill a through hole 111 and a hole 112 on the substrate 11. The ground portion 131 of the radiating element 13 is connected to grounding element 12 on the first surface S1 of the substrate 11 via the through hole 111, and the cable 15 passes from the first surface S1 of the substrate 11 via the hole 112 to the feeding portion 133 of the radiating element 13.

Figure 4:
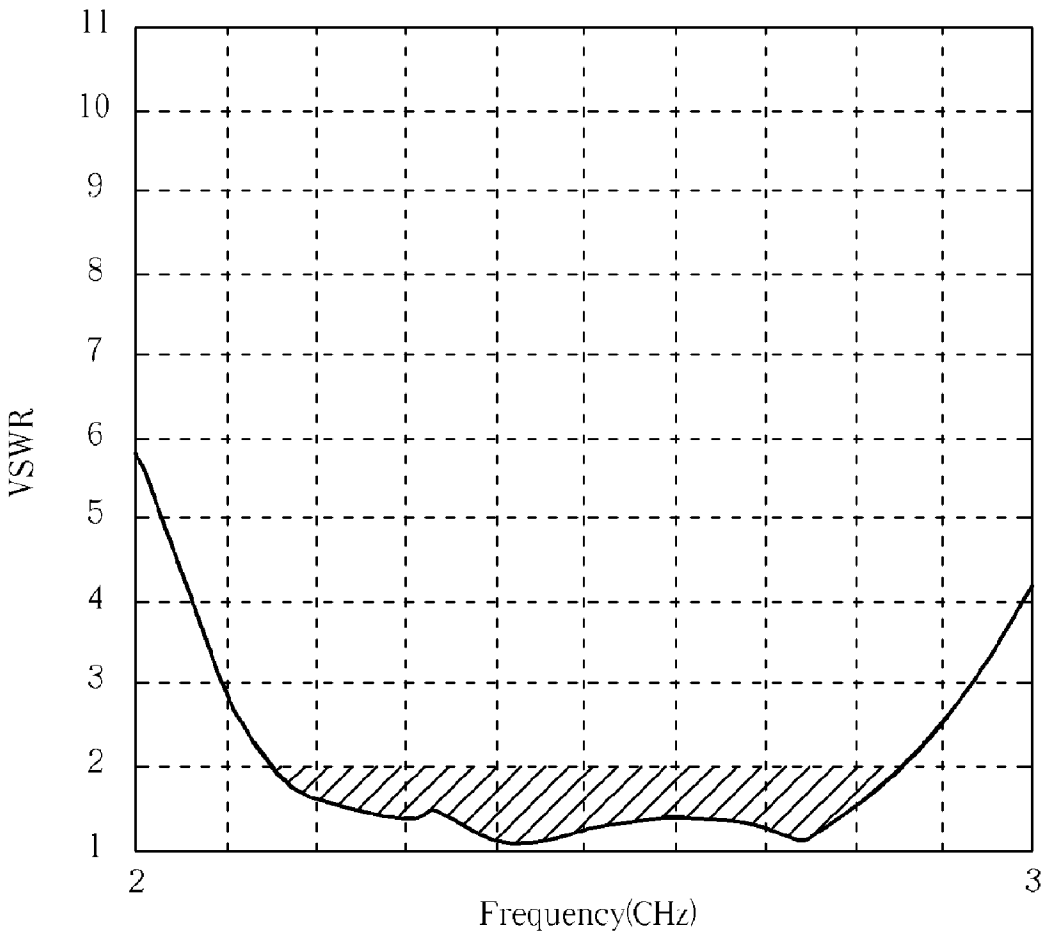
FIG. 4 is a perspective view of an antenna of an embodiment of the invention showing a VSWR diagram ranging from 2 to 3 GHz.

The grounding element 12 of the antenna 1 is used as the radiation element of an antenna so that the entire size of the antenna 1 can be minimized. Furthermore, when the antenna 1 is installed in the device 3, the metallic housing 31 adjacent to the antenna 1 or other metal components in the device 3 may cooperate with antenna 1 to be the radiation element of the antenna 1. Thus, the antenna 1 of the invention can be regarded as a multi-radiation element antenna, improving the bandwidth thereof. Referring to FIG. 4, when VSWR is less than 2, the bandwidth is around 700~800 MHZ. Namely, the antenna 1 may not break down due to the frequency bias coming from the shutter effect of human body.

The following embodiments will follow the basic design in the FIG. 2 and FIG. 3. Particularly, the embodiments described in the following may apply alternatively to achieve the best signal transmitting effect.

Figure 5:
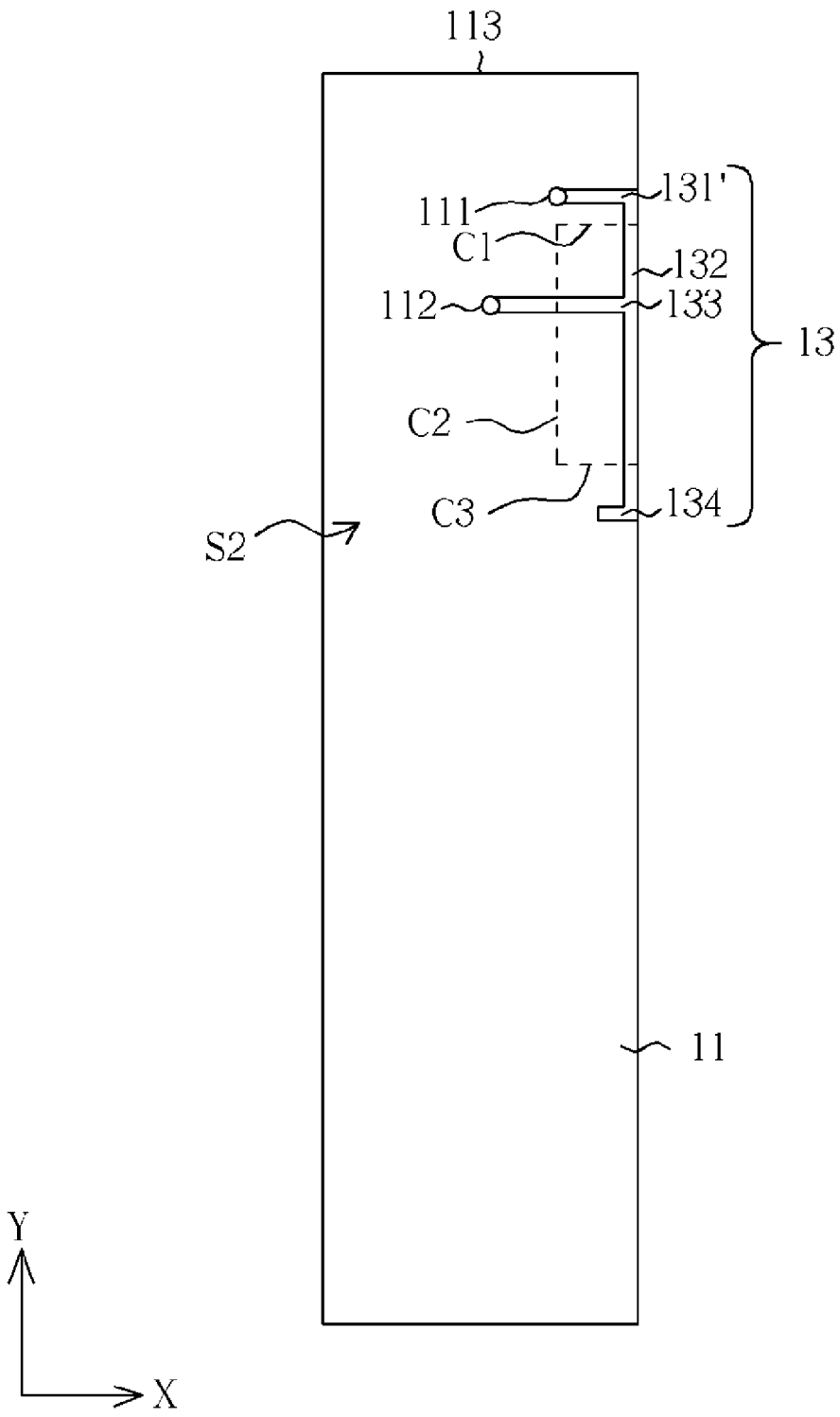
FIG. 5 is a perspective view of an embodiment of the ground portion of an antenna.

FIG. 5 is a perspective view of an embodiment of the ground portion 131' of the antenna 1. In this embodiment, the ground portion 131' is parallel to the first edge C1 of the opening C, and the projection of the ground portion 131' on the first surface S1 is located adjacent to the first edge C1 of the opening C. Specifically, the projection of the ground portion 131' on the first surface S1 is above the first edge C1 of the opening C with a distance formed there between.

Figure 6:
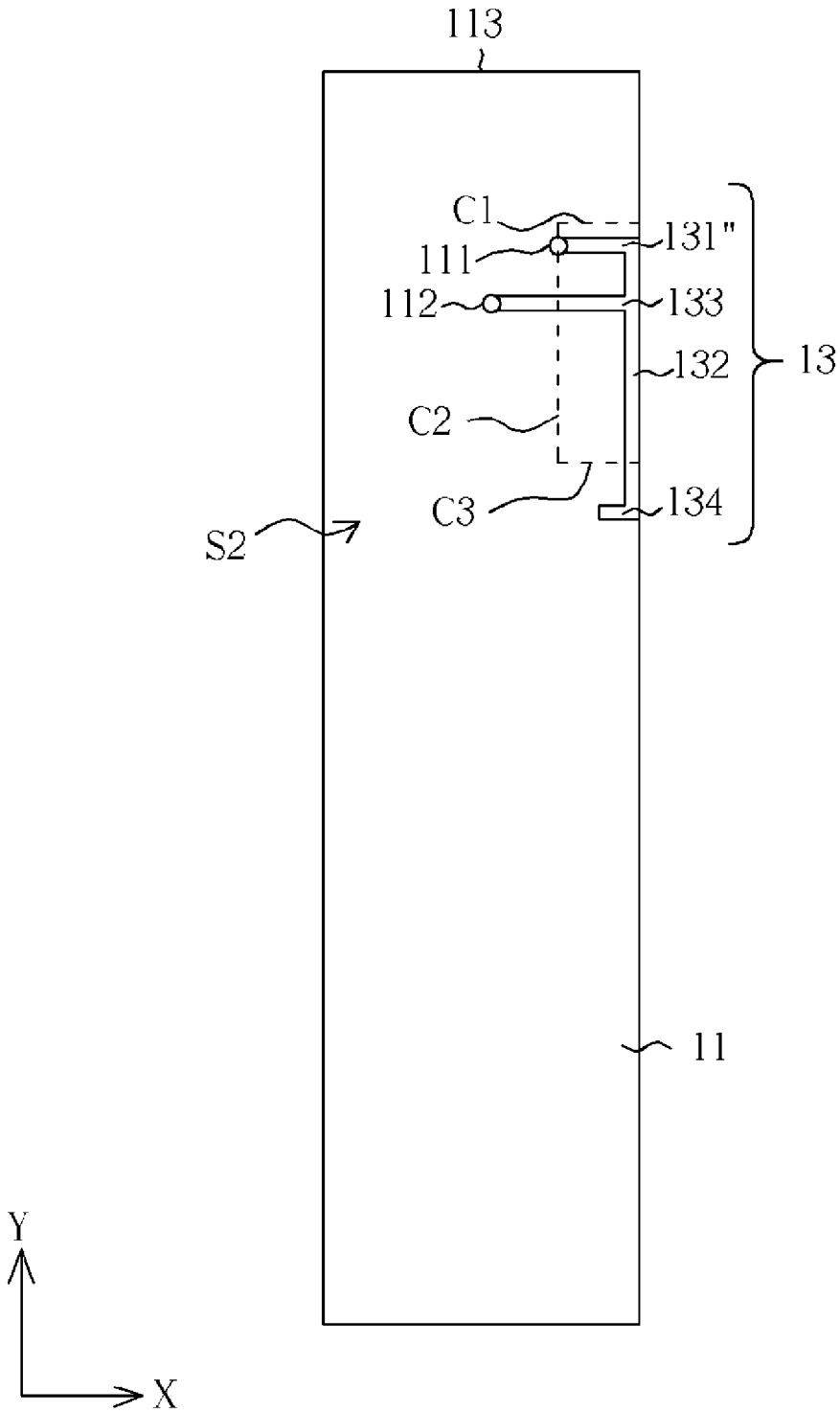
FIG. 6 is a perspective view of another embodiment of the ground portion of an antenna.

FIG. 6 is a perspective view of another embodiment of the ground portion 131" of the antenna 1. In this embodiment, the ground portion 131" is parallel to the first edge C1 of the opening C, and the projection of the ground portion 131" on the first surface S1 is located adjacent to the first edge C1 of the opening C. Specifically, the projection of the ground portion 131' on the first surface S1 is below the first edge C1 of the opening C with a distance formed there between.

Figure 7:
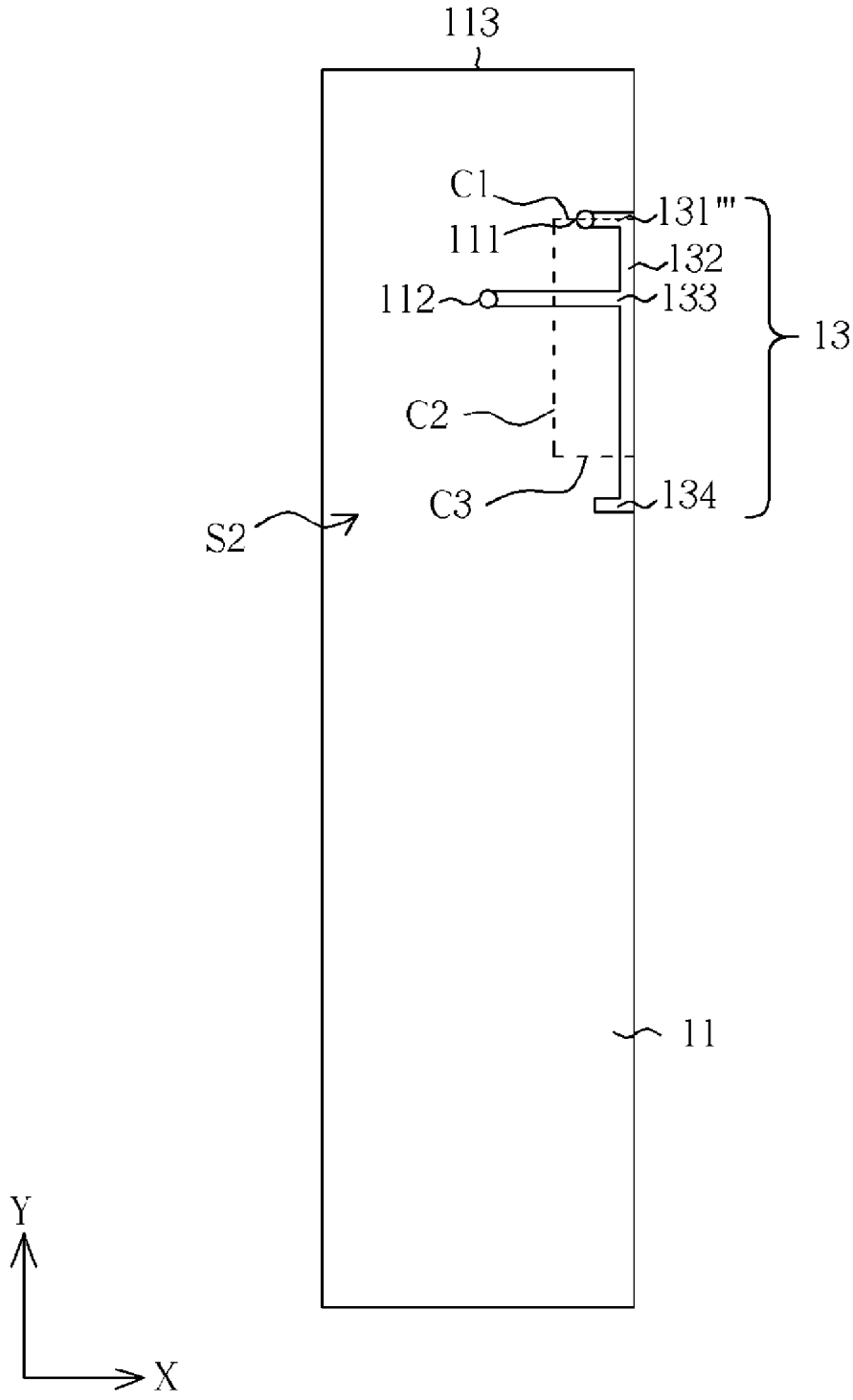
FIG. 7 is a perspective view of another embodiment of the ground portion of an antenna.

FIG. 7 is a perspective view of another embodiment of the ground portion 131'" of the antenna 1. In this embodiment, the ground portion 131'" is parallel to the first edge C1 of the opening C, and the projection of the ground portion 131'" on the first surface S1 is located on the first edge C1 of the opening C. Specifically, the length of the ground portion 131'" is less than the width of the opening C. However, in some embodiments, the length of the ground portion 131'" may be longer than the width of the opening C.

Figure 8:
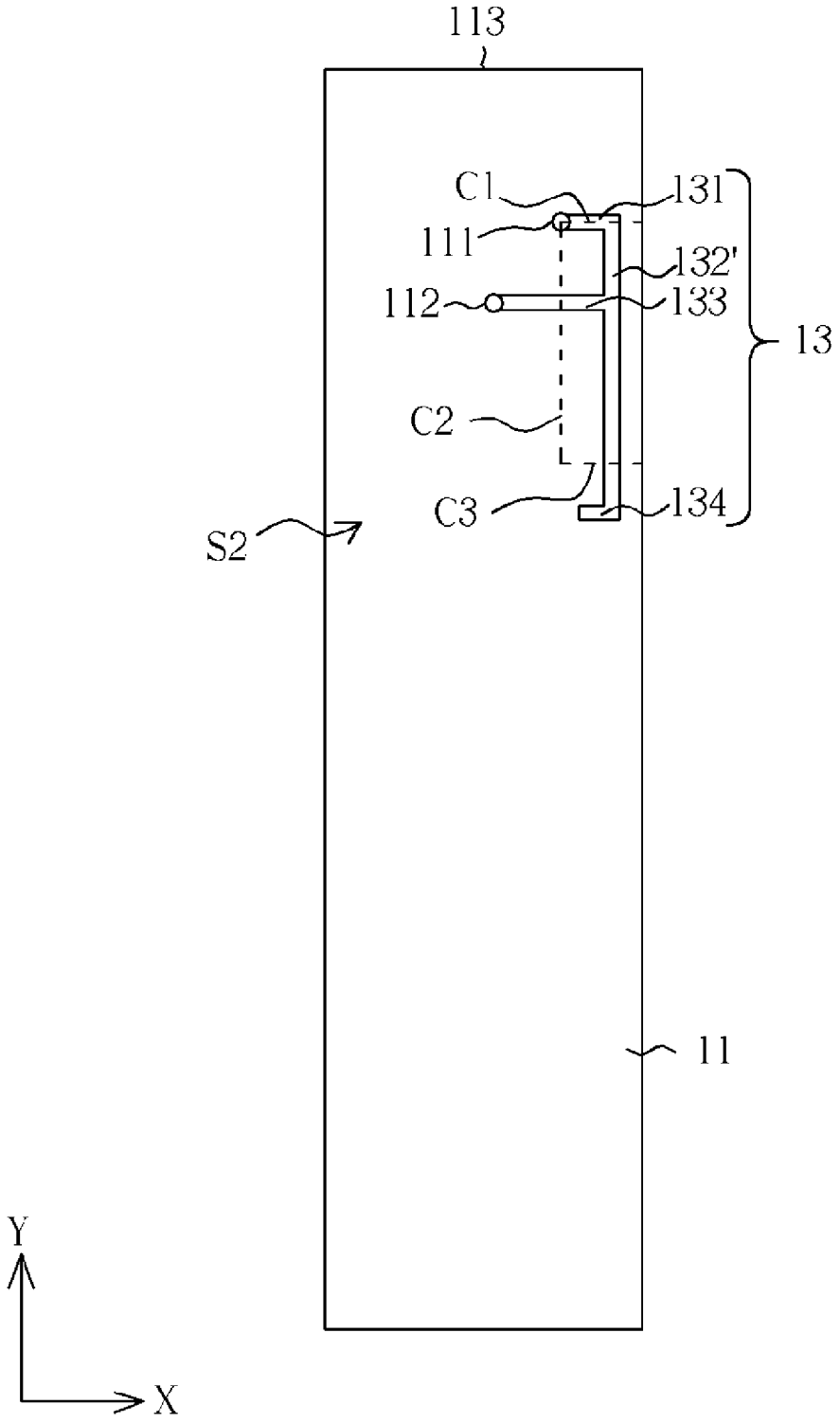
FIG. 8 is a perspective view of an embodiment of the interconnection portion of an antenna.

FIG. 8 is a perspective view of an embodiment of the interconnection portion 132' of the antenna 1. The interconnection portion 132' corresponds to the opening of the opening C, and is parallel to the edge 121 of the grounding element 12. Specifically, the interconnection portion 132' is located on the left side of the edge 121 with a distance formed there between.

Figure 9:
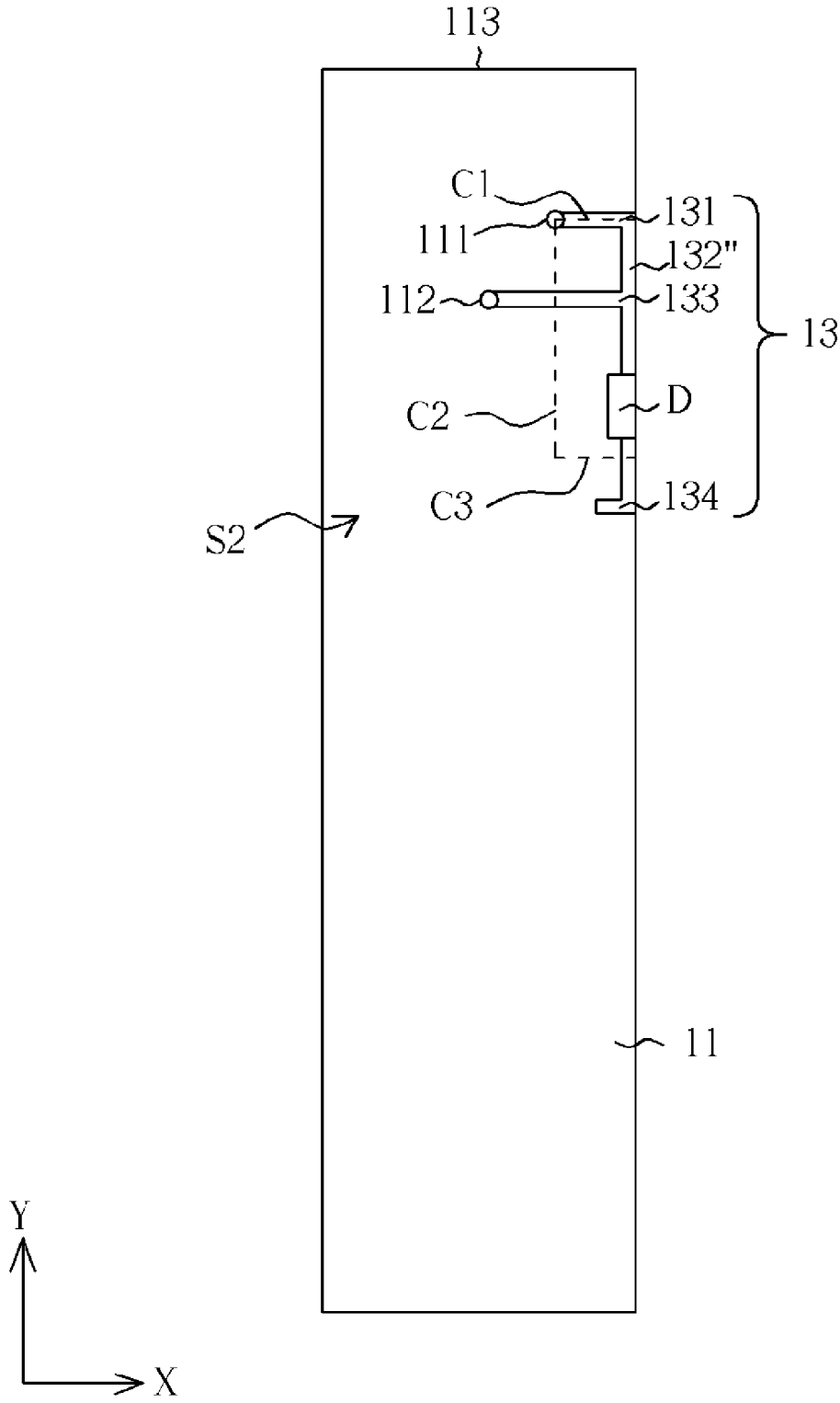
FIG. 9 is a perspective view of another embodiment of the interconnection portion of an antenna.

FIG. 9 is a perspective view of another embodiment of the interconnection portion 132" of the antenna 1. The interconnection portion 132" corresponds to the opening of the opening C and is substantially parallel to the edge 121 of the grounding element 12. The interconnection portion 132" comprises a deformation portion D, and the deformation portion D has a different shape from the interconnection portion 132". For example, as shown in FIG. 9, the width of the deformation portion D on a first axis (X axis) exceeds that of the interconnection portion 132".

Figure 10:
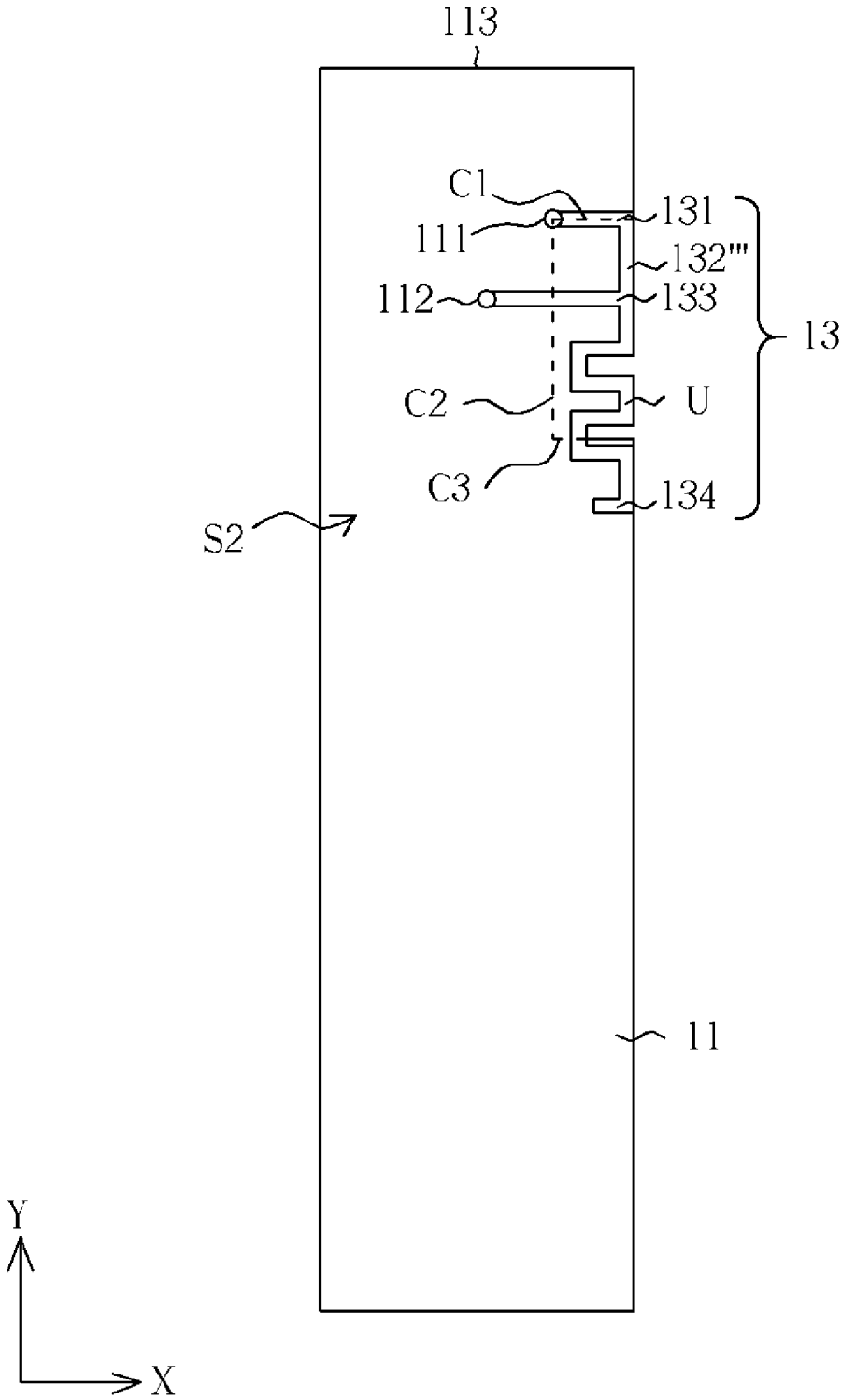
FIG. 10 is a perspective view of another embodiment of the interconnection portion of an antenna.

FIG. 10 is a perspective view of another embodiment of the interconnection portion 132'" of the antenna 1. The interconnection portion 132'" corresponds to the opening of the opening C and is substantially parallel to the edge 121 of the grounding element 12. Additionally, the interconnection portion 132'" forms a bended structure U connected to the extension portion 134.

Figure 11:
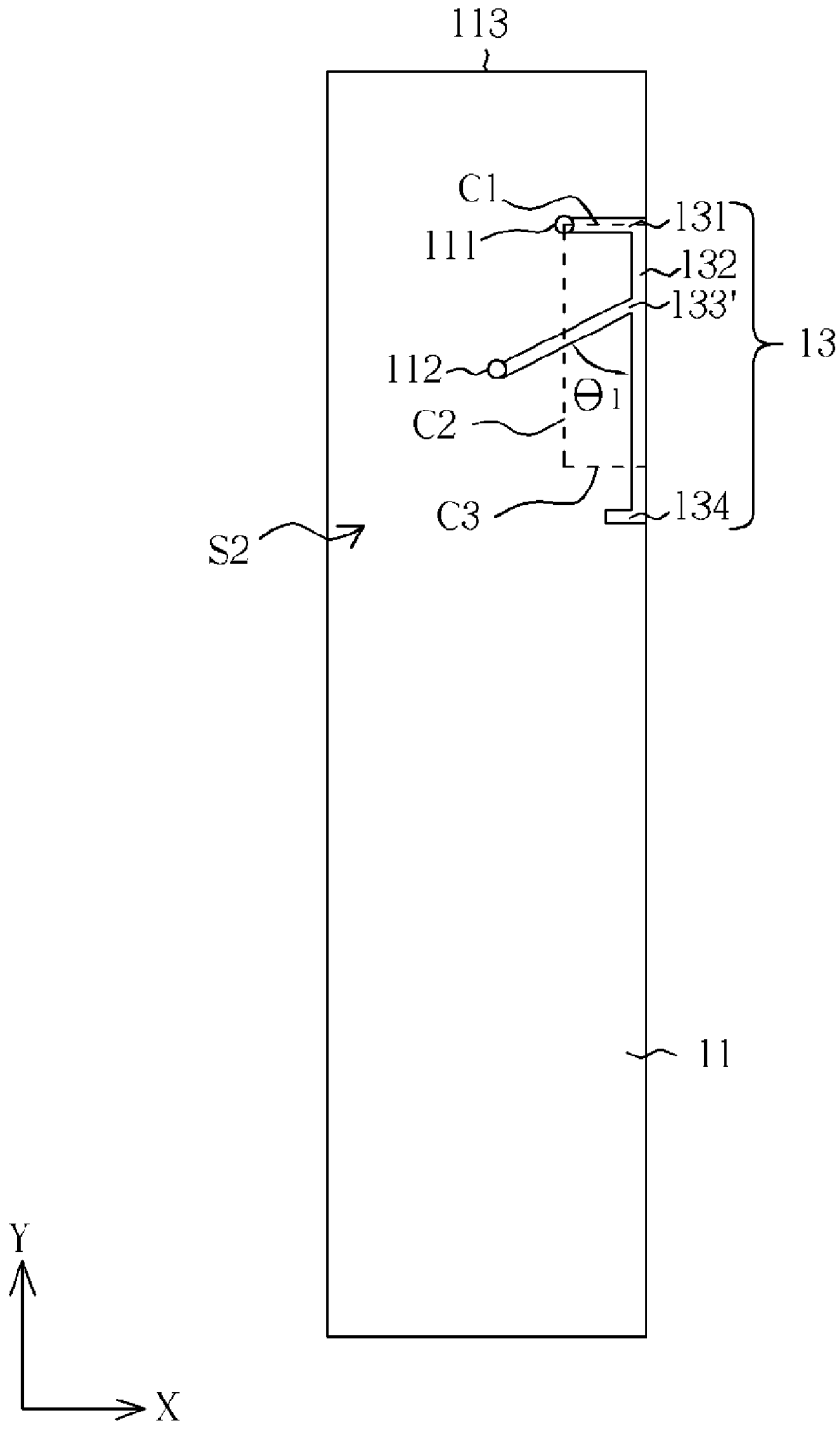
FIG. 11 is a perspective view of an embodiment of the feeding portion of an antenna.

FIG. 11 is a perspective view of an embodiment of the feeding portion 133' of the antenna 1. The feeding portion 133' crosses the second edge C2 of the opening C and the angle θ1 between the interconnection portion 132 and the feeding portion 133' is less than 90 degrees.

Figure 12:
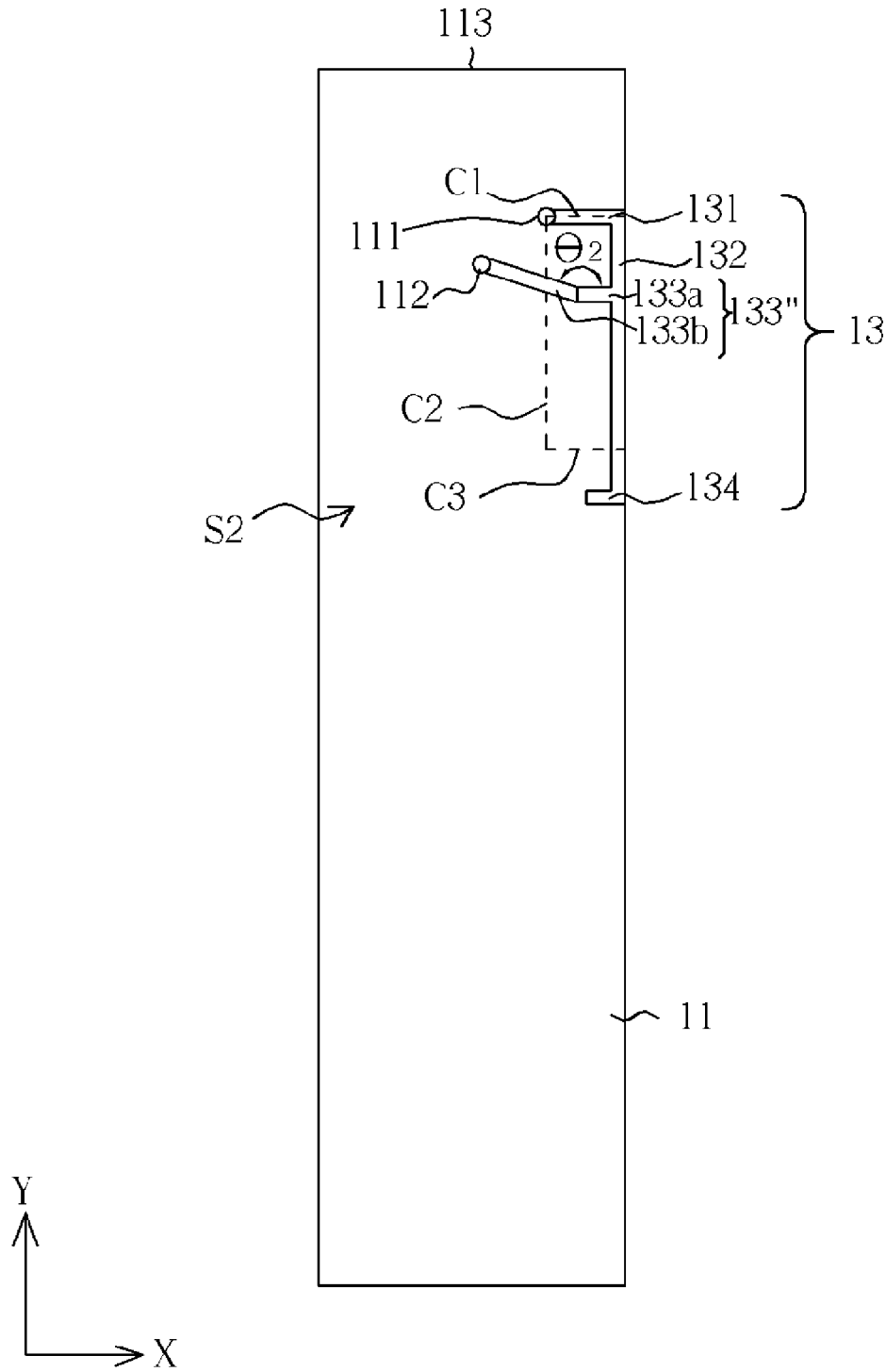
FIG. 12 is a perspective view of another embodiment of the feeding portion of an antenna.

FIG. 12 is a perspective view of another embodiment of the feeding portion 133" of the antenna 1. The feeding portion 133" comprises a first section 133*a* connected to the interconnection portion 132 and a second section 133*b* connected to the cable 15. An angle θ2 between the first section 133*a* and the second section 133*b* is from 0 degrees to 180 degrees. As shown in FIG. 12, the angle θ2 is greater than 90 degrees.

Figure 13:
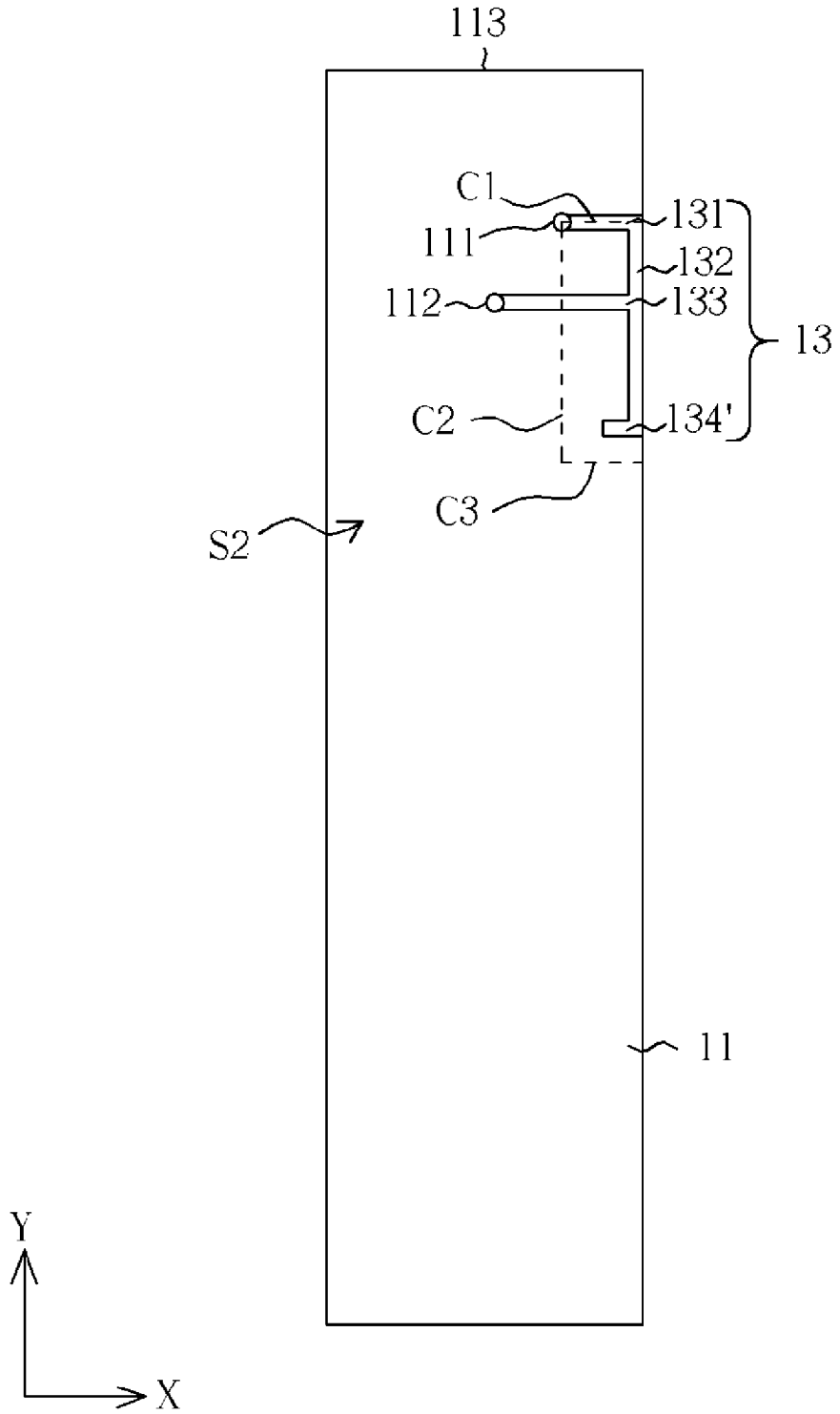
FIG. 13 is a perspective view of an embodiment of the extension portion of an antenna.

FIG. 13 is a perspective view of an embodiment of the extension portion 134' of the antenna 1. The extension portion 134' is parallel to the third edge C3 of the opening C, and the projection of the extension portion 134' on the first surface S1 is located adjacent to the third edge C3 of the opening C. Specifically, the projection of the extension portion 134' on the first surface S1 is located above the third edge C3 of the opening C with a distance formed there between.

Figure 14:
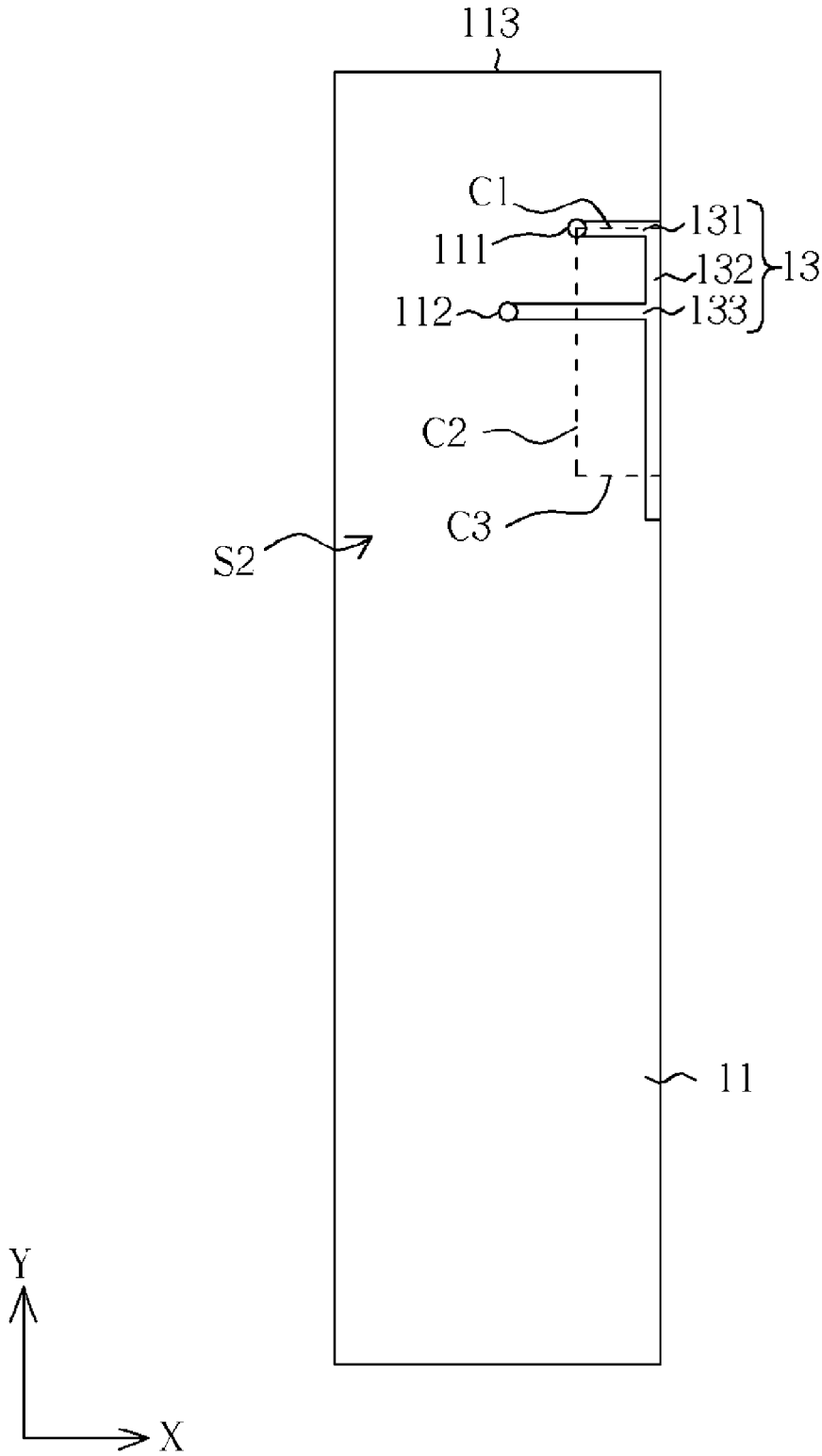
FIG. 14 is a perspective view of another embodiment of an antenna.

Please refer to FIG. 14. In this embodiment, the radiating element 13 comprises the ground portion 131, the interconnection portion 132, and the feeding portion 133. However, the radiating element 13 does not have the extension portion 134. In other words, the extension portion 134 may be treated as parallel to or connected with the interconnection portion 132, as an integral body. Furthermore, the ground portion 131, the interconnection portion 132 and the feeding portion 133 are substantially corresponding to the opening C and the arrangement thereof is substantially F-shaped.

Figure 15:
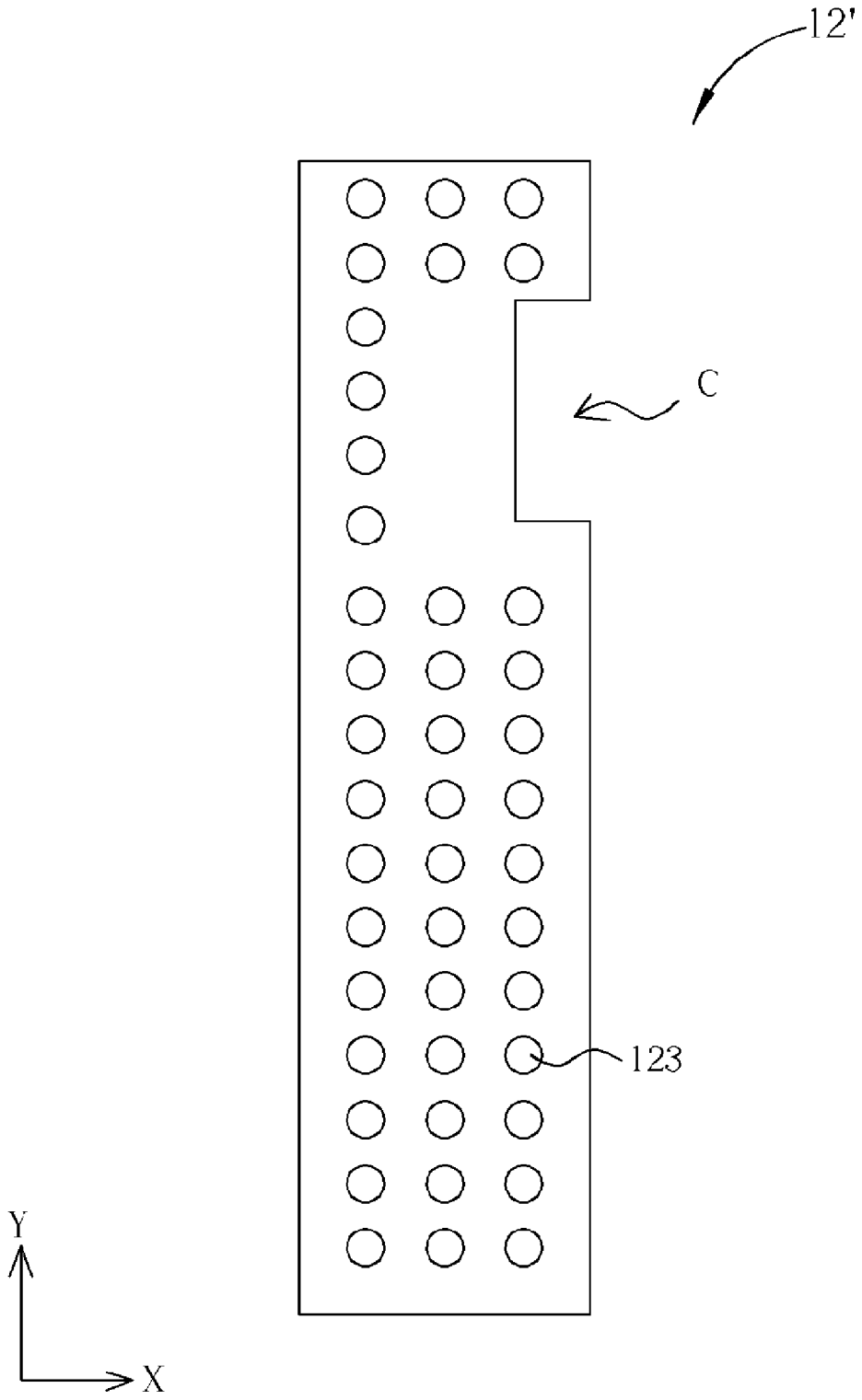
FIG. 15 is a perspective view of an embodiment of the grounding element of an antenna.

FIG. 15 shows a perspective view of an embodiment of the grounding element 12' of the antenna 1. The grounding element 12' is substantially rectangular, comprises the opening C, and further has at least one through hole 123. For example, as shown in FIG. 15, the grounding element 12' may comprise a plurality of through holes 123 arranged as a matrix.

Figure 16:
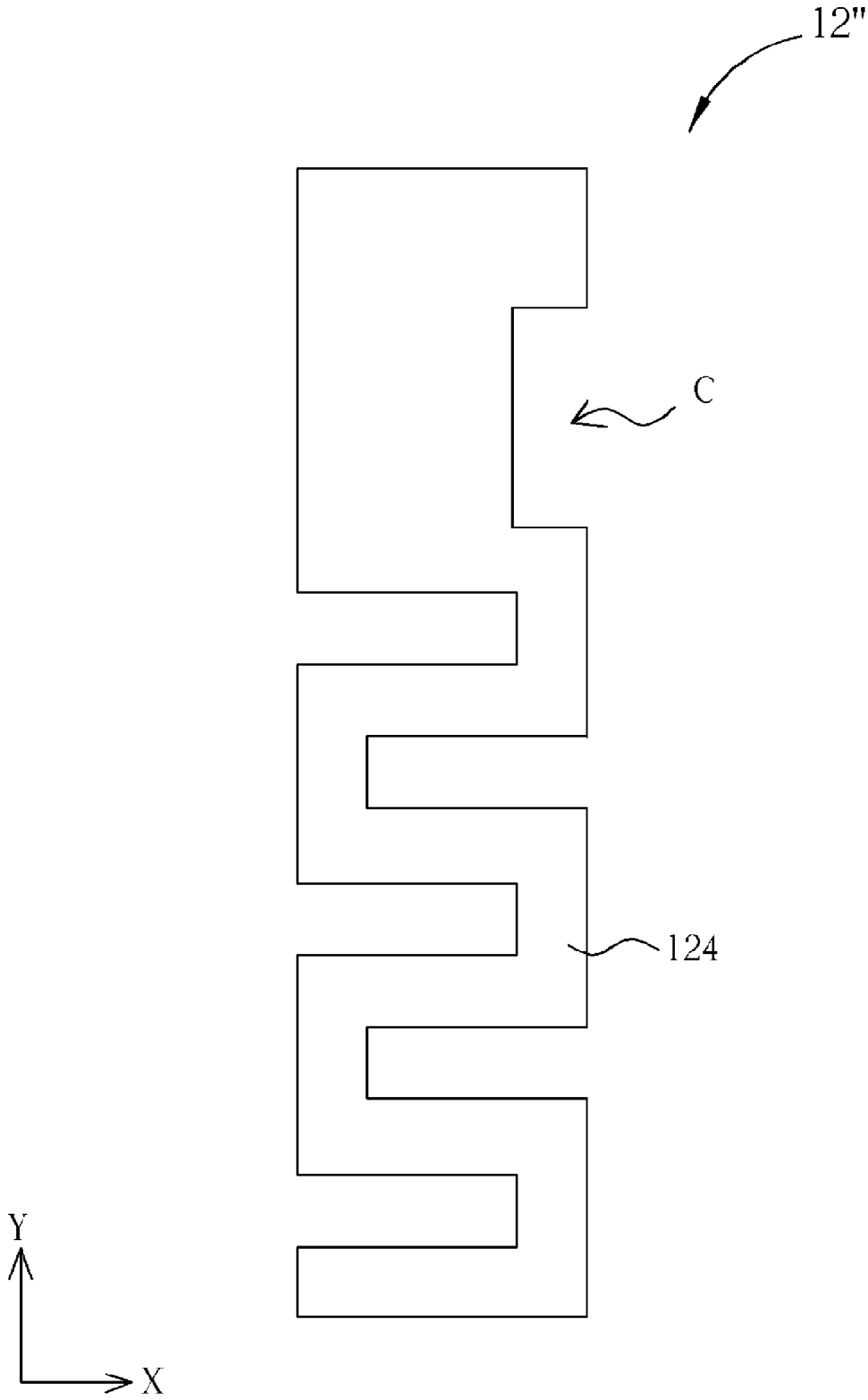
FIG. 16 is a perspective view of another embodiment of the grounding element of an antenna.

FIG. 16 shows a perspective view of another embodiment of the grounding element 12" of the antenna 1. The grounding element 12" is substantially rectangular and comprises the opening C and further has a serrate-shaped edge 124.

Figure 17:
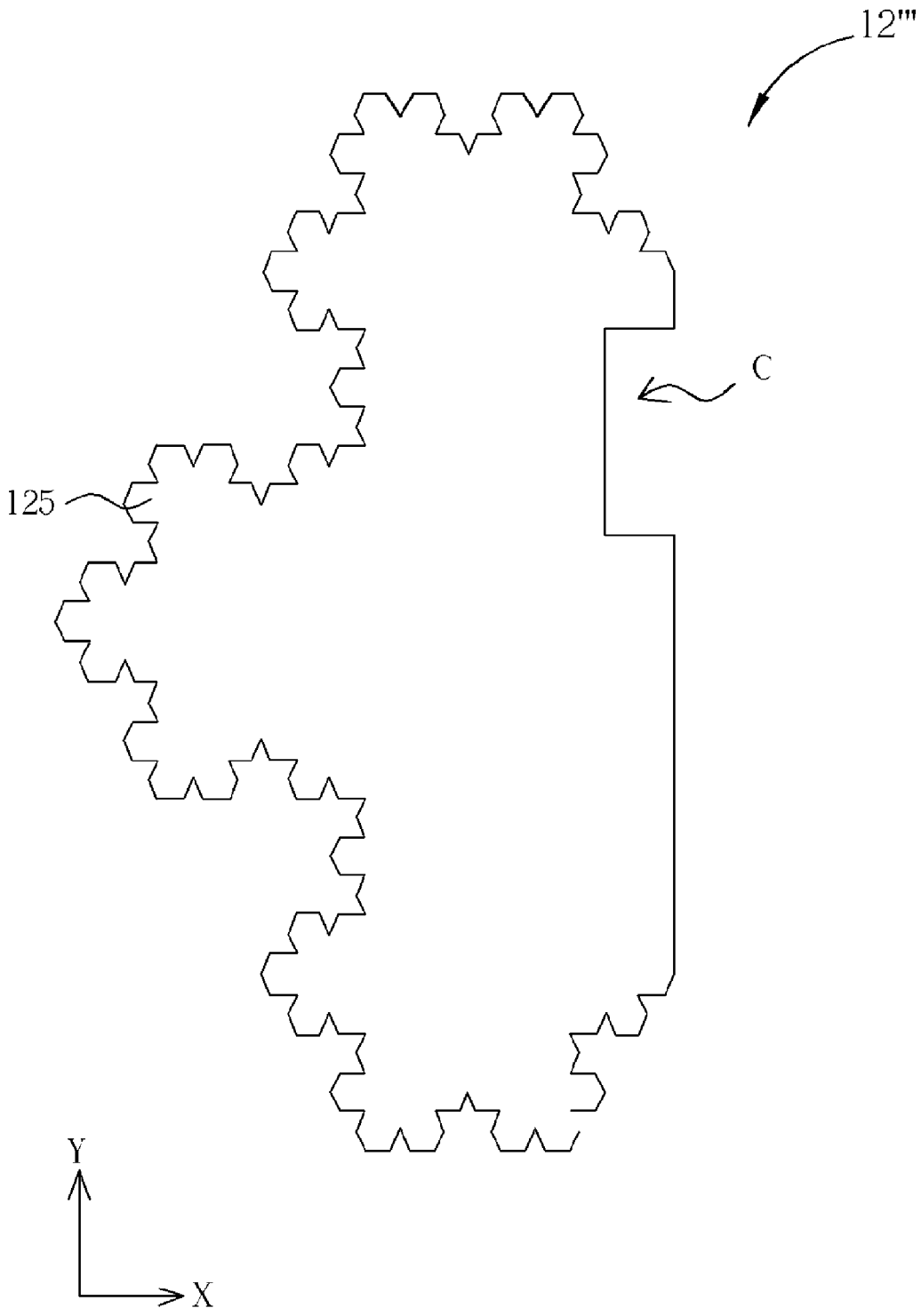
FIG. 17 is a perspective view of another embodiment of the grounding element of an antenna.

FIG. 17 shows a perspective view of another embodiment of the grounding element 12''' of the antenna 1. The grounding element 12''' comprises the opening C and further has a broken profile 125. The broken profile may be symmetric or asymmetric.

Figure 18:
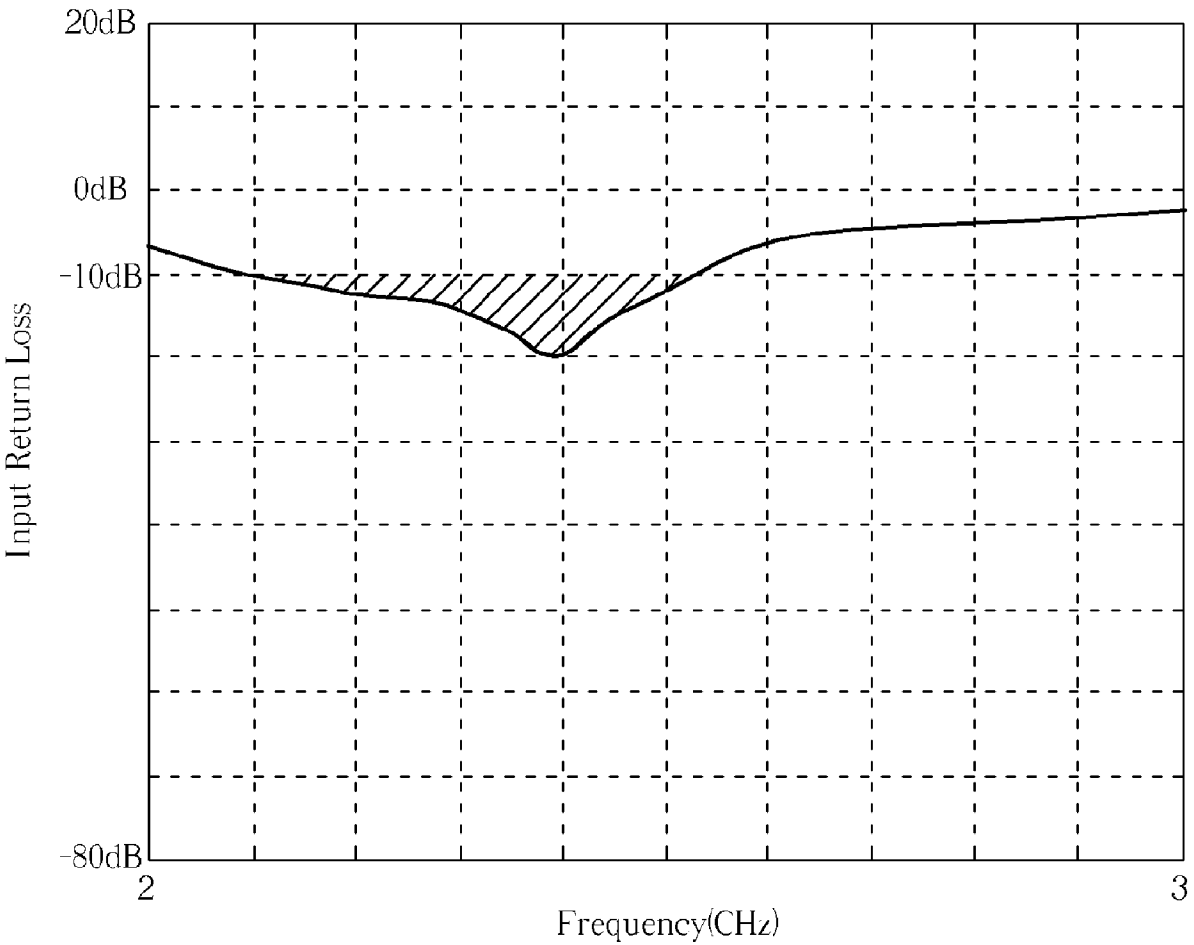
FIG. 18 is a perspective view of an antenna of an embodiment of the invention showing an Input Return Loss diagram ranging from 2 to 3 GHz.

Furthermore, the usable frequency of the antenna of an embodiment of the invention is around 2.4 GHz~2.5 GHz. When the human body approaches the antenna, as shown in FIG. 18, the Input Return Loss (<-10 dB) ranges from 2.1 GHz to 2.53 GHz. Therefore, the antenna of the invention can ensure the frequency transmitted is within 2.4 GHz~2.5 GHz, that is, an effective transmission bandwidth.

While the invention has been described by way of example and in terms of preferred embodiments, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna, comprising:

a substrate comprising a through hole;

a grounding element having an opening and disposed on a first surface of the substrate; and a radiating element disposed on a second surface of the substrate and electrically connected to the grounding element via the through hole;

wherein a projection on the first surface of the radiating element partially covers the opening.

2. The antenna as claimed in claim 1, wherein the opening is defined on an edge of the grounding element.

3. The antenna as claimed in claim 1, further comprising a cable electrically connected to the radiating element on the second surface to transmit a signal.

4. The antenna as claimed in claim 3, wherein the substrate comprises a hole, and the cable is electrically connected to the radiating element from the first surface via the hole.

5. The antenna as claimed in claim 1, wherein the grounding element comprises at least one through hole.

6. An antenna, comprising:

a substrate;

a grounding element having an opening and a serrate-shaped edge, and disposed on a first surface of the substrate; and a radiating element disposed on a second surface of the substrate and electrically connected to the grounding element;

wherein a projection on the first surface of the radiating element partially covers the opening.

7. An antenna compaising:

a substrate;

a grounding element having an opening and a broken profile, and disposed on a first surface of the substrate; and a radiating element disposed on a second surface of the substrate and electrically connected to the grounding element;

wherein a projection on the first surface of the radiating element partially covers the opening.

8. An antenna comprising:

a substrate;

a grounding element having an opening and disposed on a first surface of the substrate, a first edge of the opening being parallel to a first edge of the substrate with a distance of at least 1 mm; and a radiating element disposed on a second surface of the substrate and electrically connected to the grounding element;

wherein a projection on the first surface of the radiating element partially covers the opening.

9. The antenna as claimed in claim 8, wherein a second edge of the opening is perpendicular to the first edge of the opening and parallel to a second edge of the substrate, and the length of the second edge of the substrate is five times longer than the length of the second edge of the opening.

10. An antenna, comprising:

a substrate;

a grounding element having a substantially rectangular opening with a first edge and disposed on a first surface of the substrate; and a radiating element disposed on a second surface of the substrate and electrically connected to the grounding element, the radiating element comprising a ground portion corresponding to the first edge of the opening, one end of the ground portion being connected to the grounding element;

wherein a projection on the first surface of the radiating element partially covers the opening.

11. The antenna as claimed in claim 10, wherein the ground portion is parallel to the first edge of the opening.

12. The antenna as claimed in claim 11, wherein the length of the ground portion is substantially equal to the width of the opening.

13. The antenna as claimed in claim 11, wherein the length of the ground portion longer than the width of the opening.

14. The antenna as claimed in claim 10, wherein a projection on the first surface of the ground portion partially covers the first edge of the opening.

15. The antenna as claimed in claim 10, wherein the projection of the ground portion on the first surface is located adjacent to the first edge of the opening.

16. The antenna as claimed in claim 10, wherein the radiating element further comprises an interconnection portion connected to the ground portion, and the interconnection portion is arranged corresponding to the opening of the opening.

17. The antenna as claimed in claim 16, wherein the opening is defined on an edge of the grounding element, and the interconnection portion is parallel and adjacent to the edge of the grounding element.

18. The antenna as claimed in claim 16, wherein the interconnection portion comprises a deformation portion, and the width of the deformation portion is different from the width of the interconnection portion with respect to a first axis.

19. The antenna as claimed in claim 16, wherein the interconnection portion forms a bended structure.

20. The antenna as claimed in claim 16, wherein the opening further comprises a second edge perpendicular to the first edge of the opening, the radiating element further comprises a feeding portion across the second edge and connected to the interconnection portion, and an angle between the feeding portion and the interconnection portion is from 0 degrees to 180 degrees.

21. The antenna as claimed in claim 20, wherein the feeding portion comprises a first section connected to the interconnection portion and a second section electrically connected to a cable, and an angle between the first section and the second section is from 0 degrees to 180 degrees.

22. The antenna as claimed in claim 20, wherein an arrangement of the ground portion, the interconnection portion and the feeding portion of the radiating element is F-shaped.

23. The antenna as claimed in claim 20, wherein the opening further comprises a third edge parallel to the first edge of the opening, the radiating element further comprises an extension portion connected to the interconnection portion and corresponding to the third edge of the opening.

24. The antenna as claimed in claim 23, wherein the extension portion is parallel to the third edge of the opening.

25. The antenna as claimed in claim 23, wherein a projection of the extension portion on the first surface is located adjacent to the third edge of the opening.

26. The antenna as claimed in claim 23, wherein an arrangement of the ground portion, the interconnection portion, the feeding portion, and the extension portion of the radiating element is E-shaped.

27. A portable device, comprising:

a housing; and an antenna disposed in the housing, comprising:

a substrate comprising a through hole;

a grounding element having an opening and disposed on a first surface of the substrate; and a radiating element disposed on a second surface of the substrate and electrically connected to the grounding element via the through hole;

wherein a projection on the first surface of the radiating element partially covers the opening.

28. The portable device as claimed in claim 27, further comprising a display unit disposed in the housing, and the antenna is disposed on one side of the display unit.

29. The portable device as claimed in claim 27, wherein the portable device is a cellular phone.

* * * * *